United States Patent [19]

Dobratz et al.

[11] 4,032,827

[45] June 28, 1977

[54] DRIVER CIRCUIT ARRANGEMENT FOR A STEPPING MOTOR

[75] Inventors: Eduard Dobratz, Pfinztal-Berghausen; Herbert Schwartz, Wurmberg, both of Germany

[73] Assignee: Timex Corporation, Waterbury, Conn.

[22] Filed: Mar. 15, 1976

[21] Appl. No.: 666,807

[52] U.S. Cl. ..... 318/696; 318/685; 58/23 D

[51] Int. Cl.[2] ..... G04C 3/04

[58] Field of Search ..... 318/696, 685, 129, 130, 318/138; 58/23 D

[56] References Cited

UNITED STATES PATENTS

| | | | |
|---|---|---|---|
| 3,665,697 | 5/1972 | Dome | 58/23 D |
| 3,896,363 | 7/1975 | Kinsel et al. | 318/696 |

*Primary Examiner*—Herman Hohauser
*Attorney, Agent, or Firm*—Lawrence Hager

[57] ABSTRACT

A crystal oscillator controlled stepping motor for a timekeeping device having the high frequency oscillator coupled to a divider which reduces the oscillator frequency to the required output frequency which, in turn, is coupled to the driver circuit arrangement.

The driver circuit arrangement provides drive pulses to the stepping motor in response to the output of the divider and a feedback signal from the stepping motor. The driver circuit arrangement in response to the output of the divider and the feedback signal detects faulty indexing steps and skipped or missed indexing steps and provides drive pulses to effect a remedial action.

10 Claims, 12 Drawing Figures

DRIVER CIRCUIT ARRANGEMENT FOR A STEPPING MOTOR

BACKGROUND OF THE INVENTION

The present invention relates to a crystal oscillator controlled stepping motor.

Typically, stepping motor devices include a pivotal electrodynamically movable drive member that meshes at least indirectly by means of an indexing member with an indexing wheel and progressively drives the wheel ahead step-by-step.

In recent years, stepping motors have been used in electronic watches to drive the time indicating hands of the watch. These watches, however, are sensitive to shocks and accelerations which can index the stepping motor by one step, and under most adverse conditions even by several steps, causing the watch to run fast. A shock during the indexing moment, taking effect in a direction opposite to that of the drive, may cause the failure of an indexing step to take place causing the watch to run slow.

The following patents represent some of the prior art pertinent to the field of the present invention: U.S. Pat. No. 3,766,729 issued Oct. 23, 1973; 3,795,097 issued Mar. 5, 1974; 3,887,825 issued June 3, 1975; 3,509,437 issued Apr. 28, 1970; 3,818,690, issued June 25, 1974; 3,163,808 issued Dec. 29, 1974; 3,568,017 issued Mar. 2, 1971; and 3,896,363 issued July 22, 1975.

These patents are mentioned as being representative of the prior art and other pertinent patents may exist. None of the above cited patents are deemed to affect the patentability of the present invention.

SUMMARY OF THE INVENTION

According to one embodiment of the invention, an apparatus is provided for detecting the failure of a stepping motor to respond to input pulses generated by a control circuit and/or for detecting faulty or unwanted indexing steps and for providing drive pulses to effect a remedial action.

Accordingly, it is an object of this invention to provide a new and improved self-correcting stepping motor.

Another object of this invention is to provide an apparatus for driving a stepping motor which detects faulty, i.e., unwanted, indexing steps and effects remedial action by subsequently eliminating or not providing a corresponding number of drive pulses to the stepping motor.

A further object of this invention is to provide an apparatus for driving a stepping motor which detects the failure of the stepping motor to index properly and effects a remedial action.

A further object of this invention is to provide a new and improved driver circuit arrangement to a stepping motor.

A further object of this invention is to provide an apparatus for driving a stepping motor which provides driving pulses to the stepping motor which are caused to deviate or vary in rate and/or duration to cause the number of indexing steps taken by the stepping motor to equal the number of output pulses of a reference signal over a given period of time.

Other objects and advantages of the present invention will be more clearly seen when viewed in conjunction with the accompanying drawings wherein:

FIG. 1 is a block diagram of an oscillator controlled driver and stepping motor in accordance with the present invention;

FIGS. 2*a*, *b* and *c* denote several schematic views for the illustration of the induced voltages shown in FIG. 2*d* for three different relative positions of the drive member of the stepping motor;

FIGS, 3, 4 and 5 are circuit diagrams of three embodiments of the driver circuit of FIG. 1;

FIGS. 6*a*, 6*b* and 6*c* show the relationship between the driver input and output pulses and the induced back-emf; and FIG. 7 is a circuit diagram of a demodulator in accordance with the present invention.

DETAILED DESCRIPTION OF THE INVENTION

Figure 1:
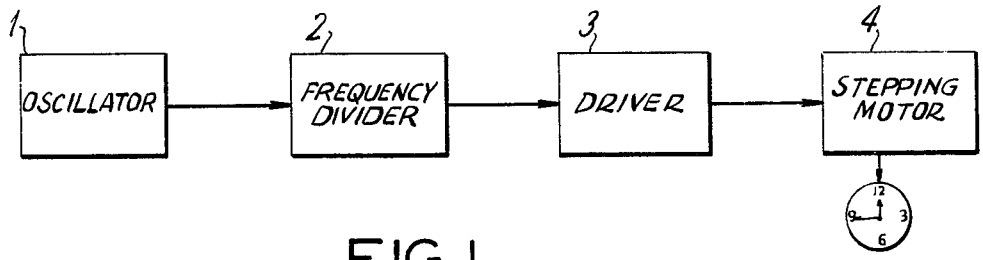

Referring now to FIG. 1 of the drawings, the preferred embodiment of the present invention comprises a timepiece having an oscillator 1, for example a quartz crystal oscillator, which supplies a high frequency output to a divider 2. The divider 2 reduces the frequency to, e.g., a one hertz output pulse signal. As shown in FIG. 6, the driver 3 provides drive (current) pulses to the motor 4, varying in numbers and/or duration, to cause the number of steps effected by the stepping motor to correspond to the number of control pulses from the divider thereby providing highly accurate timekeeping without the disadvantages present in the prior art oscillator controlled systems.

With reference to FIG. 2, when the movable drive member 5, for example, an indexing member is caused to move in the clockwise direction by occupying successively three different positions 2*a*, 2*b* and 2*c*, voltages A, B and C will be induced by the alternation in relative position between the coil element 6 and the magnets 7, 8. Movement in the opposite direction will induce voltages A′, B′ and C′ of the opposite polarity.

Figure 2A:
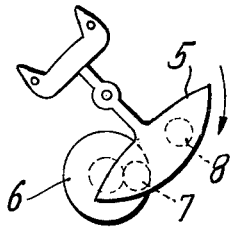
Figure 2B:
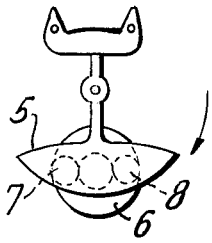

Since the induced voltage is proportional to the magnetic cross linkage, it can be observed that the induced voltage becomes a maximum in the position shown in FIG. 2*b*.

Figure 2C:
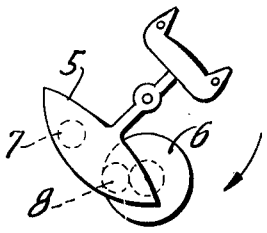
Figure 2D:
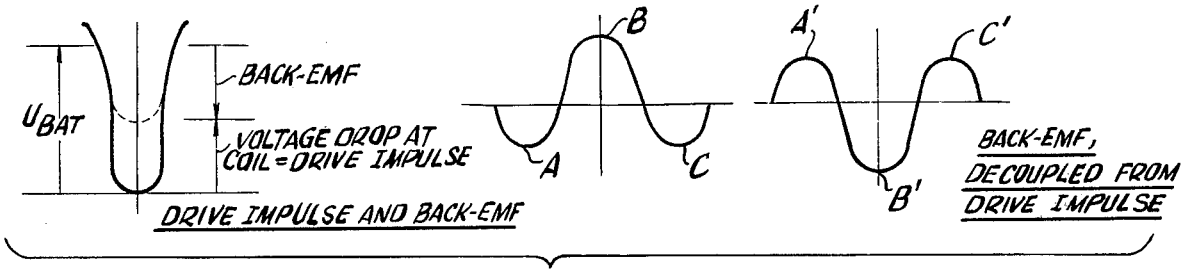

At each of both the extreme relative positions, as shown in FIGS. 2*a* and 2*c*, the cross linkage will become substantially a half of the maximum value so that the induced voltage A and C or A′ and C′ will be lowered correspondingly. Now assuming in FIG. 1 that the drive pulse from the driver causes alteration in relative position between a drive coil member and the permanent magnets, voltages, i.e., a back electromotive force (emf), will be induced as shown in FIG. 2*d*.

In accordance with the preferred embodiments of the present invention, the back-emf is used both for detecting a faulty indexing of the stepping motor and/or to cause or trigger turn-off of each drive pulse after an indexing of the stepping motor. It should be recognized, however, that in accordance with the present invention, other stepping motor index-step sensing devices can be used, for example, optic devices, magnet sensors, magnetic field dependent resistors, or an inductive switch or contact.

Figure 3:
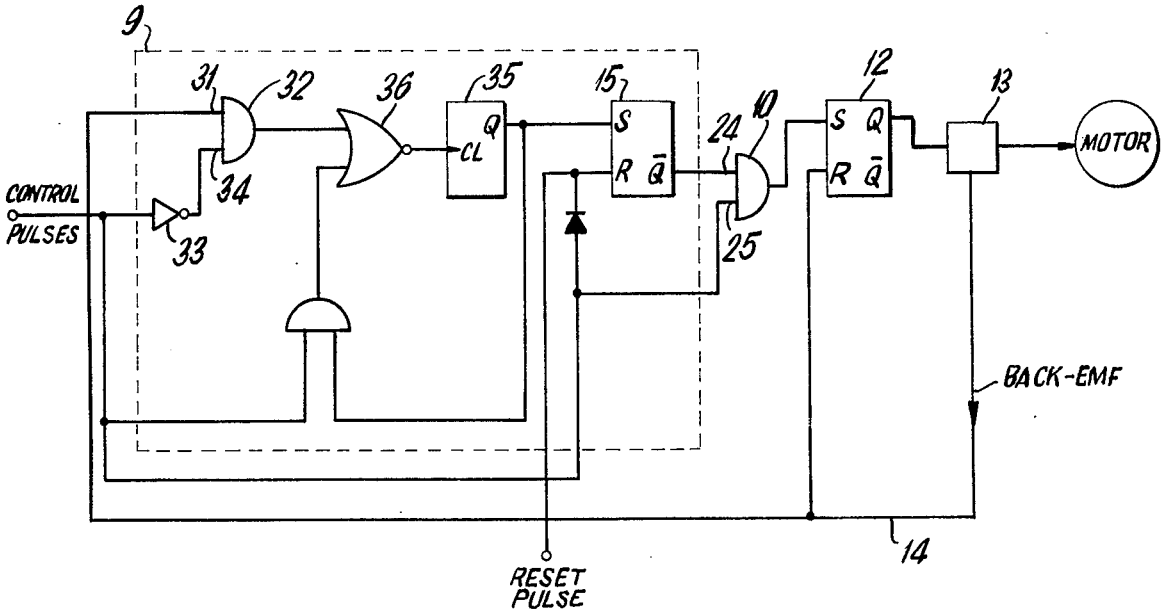

A detailed description of the circuitry of the driver will now be presented. Referring to FIG. 3, the output of the control circuit 1, 2, 3 which includes a frequency divider 2 (shown in FIG. 1) is connected to an inhibit signal generator or fault detector/indicator circuit 9 and to a first input 25 of an AND gate or inhibit logic network 10. The output Q of the inhibit signal generator 9 is connected to a second input 24 of AND gate 10.

The output of the AND gate 10 is connected to a drive pulse generator, i.e., to the set input S of flip-flop 12. The drive pulse generator is connected to the stepping motor via an index-step sensing device 13. A feedback circuit 14 is connected from the index-step sensing device 13 to the reset input R of flip-flop 12 and also to the inhibit signal generator 9.

The operation of the above described driver and stepping motor will now be described with reference to FIGS. 3 and 6. Assuming that if the output $\overline{Q}$ of flip-flop 15 is low at start up, the output of AND gate 10 will be low during the first control pulse from the frequency divider to the driver. The reset input R of flip-flop 15 is enabled by a trailing edge of the input control pulses to the driver, which causes the output $\overline{Q}$ of flip-flop 15 to go high, i.e., to a "logic 1". The high at the output $\overline{Q}$ of flip-flop 15 causes the input 24 of AND gate 10 to be enabled. The following control pulse from the frequency divider, being coupled to the other input 25 of AND gate 10, causes the output of AND gate 10 to go high. This, in turn, activates the set input S of flip-flip 12 causing its output Q to go high, and thereby to initiate or begin providing, via the index-step sensing device 13, a drive pulse to the stepping motor. At or after the trailing edge of the control pulses from the frequency divider, i.e., the input pulses to the driver, AND gate 10 is disabled which causes its output and, therefore, the input to the set input S of flip-flop 12 to go low. However, the drive pulse to the stepping motor is maintained by flip-flop 12 until it is reset, i.e., the output Q is caused to go low, by an index-step pulse signal generated in response to the back-emf signal and coupled to the reset input R of flip-flop 12. Thus, it should be readily apparent that under the above described circumstances, the leading edges of the control pulses to the driver, in the absence of an inhibit signal at input 24 (a low logic level), results in a drive pulse to the stepping motor. And the leading edges of the drive pulses 26, 27, 28 substantially correspond with the leading edges of the control pulses 20, 21, 23 to the driver, respectively.

The drive (current-voltage) pulse width or duration is maintained beyond the trailing edge of the control pulse to the inhibit or (enable) AND gate 10 by flip-flop 12 and is terminated only after the desired indexing step of the stepping motor is effected. This is accomplished by sensing the induced back-emf that is generated with each indexing of the stepping motor, and in response thereto applying a reset or index-step signal to flip-flop 12 causing its output Q to go low which, thereby, ends or terminates the drive pulse to the stepping motor.

With another control pulse of the driver, output Q of flip-flop 12 is again caused to go high resulting in another drive pulse to the stepping motor. It being understood that input 24 of AND gate 10 is at this time at a high due to the resetting of flip-flop 15 by a reset pulse or by the trailing edge of the preceding control pulse to the driver. This drive pulse is ended, as the first, after the desired indexing of the stepping motor is effected. This sequence will continue for each control pulse to the driver 3 from the control circuit.

Figures 6A, 6B, 6C, 7:
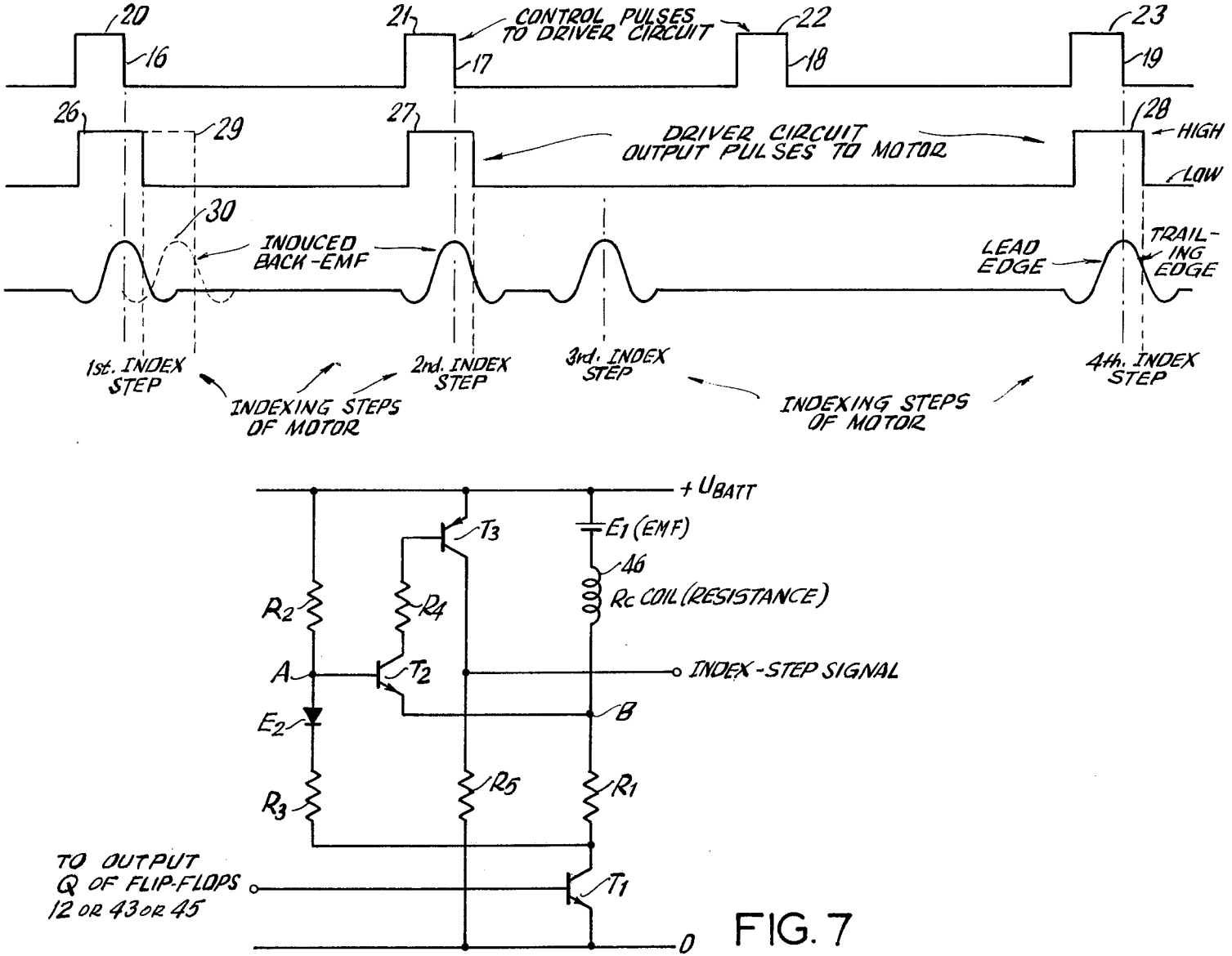

If during the normal indexing moment, effected substantially during the drive pulse periods indicated by the solid line waveform in FIG. 6*b*, the indexing step is prevented, for example, by a shock taking effect in the opposite direction to that of the drive, the drive pulse to the motor is extended or maintained as shown by the dashed line 29, until the obstacle of the indexing is removed and the indexing step is effected. When the desired indexing step is effected, the induced back-emf is delayed by the delay of the indexing step. The delayed induced back-emf is shown by dashed waveform 30 in FIG. 6*c*, as corresponding to the delayed drive pulse 29. The back-emf is detected and decoupled from the drive pulses by the index-step sensing device 13. The decoupled back-emf signal is used to generate an index-step signal which is coupled to the reset R of flip-flop 12 causing flip-flop 12 to reset and, thereby, ending the drive pulse to the stepping motor.

On the other hand, outside influences such as shocks and accelerations can index the stepping motor, e.g., the third indexing step illustrated in FIG. 6*c*, by one or more steps. If uncorrected this will cause the watch to run fast.

Each indexing step, as noted above, induces a back-emf signal. This back-emf signal and signal initiated thereby is coupled, via feedback circuit 14, to an input 31 of AND gate 32. And since, at this time, the output of invertor 33 being coupled to the input 34 of AND gate 32 is high, a clock pulse is provided to the clock input CL of flip-flop 35, via NOR gate 36, which thereupon provides a high or "logic 1 at output Q. This high output being coupled to the set input S of flip-flop 15 causes its output $\overline{Q}$ and, therefore, input 24 of AND gate 10 to go low. The low or inhibit signal on input 24 disables AND gate 10 and causes the driver to skip or not provide a drive pulse, for example, corresponding to control pulse 22. The trailing edge 18, however, of this control pulse 22 being coupled to the reset input R of flip-flop 15, resets flip-flop 15 and, thereby, enables AND gate 10 for the following control pulse to the driver, for example, pulse 23.

It can be assumed that with seconds stepping or parts thereof of a stepping motor that the disturbances resulting in faults will happen only once between two drive pulses. Therefore, a simple flip-flop 35 is sufficient for counting and storing. With longer time intervals between two drive pulses, for example, where minute index steps are used, several faulty indexing steps may occur. In this case, a bi-directional counter can be used to add the number of faults. The following control pulses substract or down-count the counter to a zero count. The stepping motor is at a standstill during this period. The next control pulse will then be able to trigger or initiate indexing again.

Figure 4:
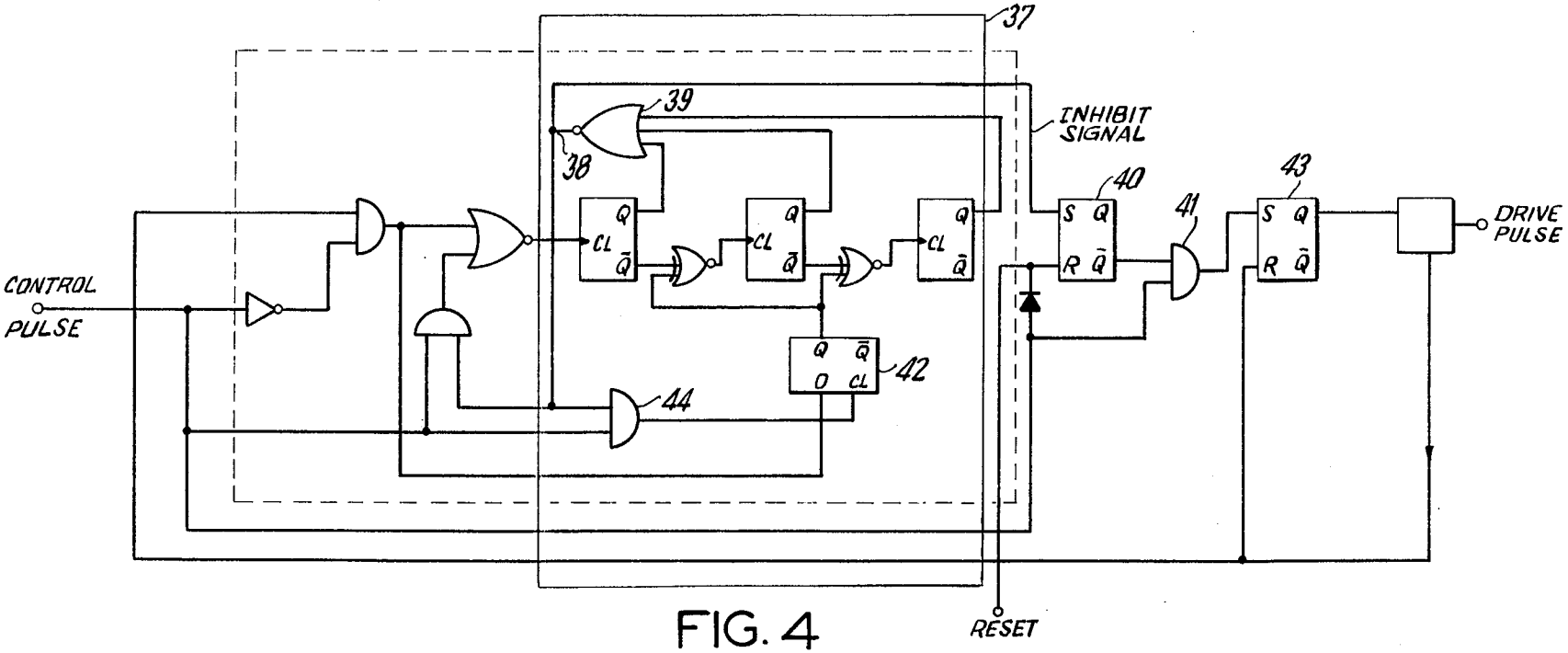

The driver circuit shown in FIG. 4 is similar to the driver shown in FIG. 3 with the difference being that a bi-directional counter 37 is provided for counting several faulty indexing steps. Since the operation of bi-directional counters is well known in the art field, an exhaustive explanation of the operation of this circuit will not be described to avoid prolixity.

Briefly, however, assuming that several faulty indexing steps are counted between two control pulses, the representative outputs of the bi-directional counter corresponding in binary manner to the number of faulty indexing steps that occurred causes output 38 of OR gate 39 to go high. This logic high is coupled to the input S of flip-flop 40, whose output $\overline{Q}$ disables AND gate 41, which prevents or inhibits drive pulses to the stepping motor. Logic 1 or a high level at output 38 together with the following control pulse to the drive circuit resets the D-flip-flop 42 via AND gate 44 (Q output at low). The counter can now count in reverse or down-count. The following control pulse, reduces the counter by one. And each successive control pulse reduces the counter 37 until the output of the counter equals zero, i.e., a low logic 0 level on output 38, which is coupled to the input S of flip-flop 40. The following control pulse resets flip-flop 40 and causes the driver to provide a drive pulse to the stepping motor, i.e., the Q output of flip-flop 43 goes high.

Figure 5:
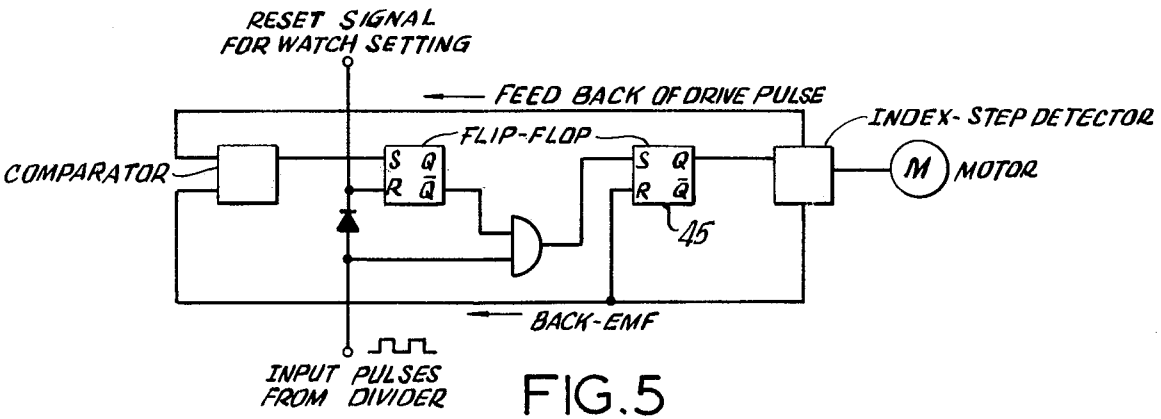

The drive circuit in FIG. 5 is generally similar to the driver shown in FIGS. 3 and 4 with the difference being that a comparator is used to detect/indicate faulty indexing by comparing if each index-step signal corresponds to a drive pulse from the drive pulse generator 45.

FIG. 7 is a detailed schematic diagram of an index-step sensing device in accordance with the invention. The drive pulse is applied across the coil 46 of the stepping motor and can be described or represented as consisting of the voltage drop at or across the ohmic resistance $R_c$ of the coil 46 and the induced voltage across the coil 46. In accordance with one embodiment of the invention, the induced voltage is detected or decoupled from the voltage drop across the coil resistance and used to provide or generate a signal for each step taken by the stepping motor. A bridge circuit is formed by the coil 46 with induced voltage $E_1$, resistors $R_1$, $R_2$, $R_3$ and diode $E_2$. The diode $E_2$ reduces the $R_3$ value and reduces the temperature coefficient of the base-emitter junction of transistor $T_2$ . The bridge has to be balanced in such a way that the voltage between point A and B exceeds the threshold voltage of the base-emitter junction of transistor $T_2$ at full amplitude of the coil. In this manner, transistor $T_2$ and consequently $T_3$ will be conductive and an index-step signal is provided to the feedback circuit.

A drive pulse only (no movement of the coil) unbalances the bridge circuit which causes the voltage between A and B to decrease blocking or disabling transistor $T_2$ and $T_3$ resulting in the absence of a feedback pulse.

An induced voltage caused by outside influence (without any drive pulse), higher than the threshold voltage opens $T_2$ and $T_3$ which results in a feedback pulse to be provided to the driver.

The voltage between A and B is given by the formula:

$$U_{AB} = (R3/(R2+R3))\ (U_{BAT} - E_2) + E_1 - (R1/(R1+Rc)\ (U_{BAT} - E_1)$$

It is to be understood that the above described arrangments are illustrative of the application of the principles of the invention. Other arrangments may be devised by those skilled in the art without departing from the spirit and scope of the invention.

We claim:

1. An apparatus for providing drive pulses to a stepping motor to correspond indexing to the number of control pulses generated by a control circuit, the apparatus comprising:

means connected to the stepping motor for generating an index-step signal in response to each index-step of the stepping motor;

drive pulse generator means connected to the stepping motor for initiating a drive pulse to the stepping motor in response to a control pulse and terminating the drive pulse in response to a corresponding index-step signal;

means responsive to the control pulses and the index-step signal for generating an inhibit signal in response to the presence of any index-step signals and the absence of a corresponding number of control pulses, the inhibit signal being removed following the corresponding number of control pulses; and means connected to the drive pulse generator means being responsive to the inhibit signal for inhibiting at least one drive pulse to the stepping motor.

2. The apparatus of claim 1, wherein the means for generating the inhibit signal further comprises:

a gating network for generating a fault signal is response to each index-step signal occurring between successive control pulses;

a counter circuit for producing a count signal of the number of fault signals generated, said counter circuit being reset to a zero count signal in response to a number of next occurring control pulses being equal to said count signal; and a logic circuit having a first input responsive to the count signal and a reset input responsive to the control pulses, said logic circuit providing the inhibit signal in response to the count signal and terminating the inhibit signal in response to the zero count signal and the control pulses.

3. The apparatus in claim 2, wherein:

the logic circuit is a flip-flop circuit having the reset input responsive to the trailing edge of the control pulses.

4. The apparatus of claim 2, wherein:

the counter circuit is a bi-directional counter.

5. The apparatus of claim 1, wherein the means for generating an index-step further comprises:

a demodulator circuit for detecting induced back electromotive force with each index-step and for providing the index-step signal in response thereto.

6. The apparatus in claim 1, wherein:

the drive pulse generator means is a logic circuit having a first input responsive to the simultaneous occurrence of the absence of the inhibit signal and the control pulses to initiate a drive current pulse to the stepping motor and a reset input responsive to the index-step signal to terminate the drive current pulse.

7. The apparatus of claim 1, wherein the means for preventing drive current to the stepping motor further comprises:

means connected between the drive pulse generator means and the control circuit and being responsive to the inhibit signal to inhibit response of the drive pulse generator means to the control pulse.

8. The apparatus of claim 1, wherein:

the drive pulse generator means being capable of providing drive pulses at an output which have different durations.

9. The apparatus of claim 1, wherein the means for generating the inhibit signal further comprises:

a first logic circuit having a first input being coupled to the output of the drive pulse generator and a clock input responsive to the index-step signal, said logic circuit providing a fault signal in response to the index-step signal and the absence of a corresponding drive pulse; and a second logic circuit having a first input responsive to the fault signal and a reset input responsive to the control pulses, said logic circuit providing the inhibit signal is response to the fault signal.

10. Driver circuit arrangement for a stepping motor to correspond indexing to the number of control pulses generated by a control circuit, the circuit comprising:

means connected to the stepping motor for generating an index-step signal in response to each index-step of the stepping motor;

means for generating an inhibit signal comprising a gating network for generating a fault signal in response to each index-step signal and the absence of a corresponding drive pulse to the stepping motor, a counter circuit for producing a count signal of the number of fault signals generated, said counter circuit being reset to a zero count signal in response to a number of next occurring control pulses being equal to said count signal, a first logic circuit having a first input responsive to the count signal and a reset input responsive to the control pulses, and logic circuit providing the inhibit signal in response to the count signal and terminating the inhibit signal in response to the zero count signal and the control pulses;

drive pulse generator means comprising a second logic circuit having a first input responsive to the control pulses to initiate a drive pulse to the stepping motor and a reset input responsive to the index-step signal to end the drive pulse; and a gating circuit connected between the drive pulse generator means and the control circuit and being responsive to the inhibit signal to prevent response of the drive pulse generator means to the control pulse.

* * * * *